United States Patent [19]

Howard

[11] Patent Number: 4,466,570

[45] Date of Patent: Aug. 21, 1984

[54] MULTI-SEGMENT ELECTRICALLY INSULATED RAIL JOINT

[75] Inventor: James T. Howard, Jamaica, N.Y.

[73] Assignee: New York City Transit Authority, Brooklyn, N.Y.

[21] Appl. No.: 418,997

[22] Filed: Sep. 16, 1982

[51] Int. Cl.[3] ..... E01B 11/54; E01B 11/58

[52] U.S. Cl. ..... 238/153; 238/159; 238/226; 238/227; 238/243

[58] Field of Search ..... 238/152, 153, 159, 218, 238/225, 226, 227, 243

[56] References Cited

U.S. PATENT DOCUMENTS

| | | | |
|---|---|---|---|
| 369,446 | 9/1887 | Georget | 238/225 |
| 735,631 | 8/1903 | Weber | 238/225 |
| 761,526 | 5/1904 | Mock | 238/218 |
| 991,488 | 5/1911 | de Remer | 238/218 |
| 993,153 | 5/1911 | Cusick | 238/226 |
| 1,967,509 | 7/1934 | Jackson | 238/243 |
| 2,143,766 | 1/1939 | Dill | 238/218 |
| 2,160,310 | 5/1939 | Johnson et al. | 238/226 |
| 3,837,948 | 9/1974 | Nelson et al. | 238/152 |
| 4,292,110 | 9/1981 | Marteness | 238/159 |

FOREIGN PATENT DOCUMENTS

| | | | |
|---|---|---|---|
| 656905 | 1/1963 | Canada | 238/159 |

*Primary Examiner*—Robert B. Reeves
*Assistant Examiner*—David F. Hubbuch
*Attorney, Agent, or Firm*—Anthony J. Casella; Gerald E. Hespos

[57] ABSTRACT

An insulated joint is provided for use between sections of rail that are disposed in adjacent signal circuits. The insulated joint includes a separator disposed between a pair of dielectric end posts. The end posts have a plan configuration substantially identical to the cross section of the rail sections with which they are used. The separator is constructed from a material having sufficient strength to enable it to withstand the forces exerted by the wheels of the train. The insulating fabric disposed between the joint bar and the rail is removed at least in the portion thereof adjacent the separator head portion thereby avoiding the problem of having the insulating fabric wear adjacent the separator. In locations where the separator would be subject to greater than normal forces, a head portion with a height greater than that of the rail sections is provided to increase the strength of the separator. The joint bar in turn is appropriately configured to accept the head portion of the separator and can be reinforced for added strength.

10 Claims, 10 Drawing Figures

MULTI-SEGMENT ELECTRICALLY INSULATED RAIL JOINT

BACKGROUND OF THE INVENTION

Railroad systems use signals to indicate when a train may proceed safely or when it is required to stop. In the typical railway system electrical circuitry is relied upon to sense the presence of trains. The presence or absence of a train in one location triggers signals in other locations on the system. In many such signal systems electrical current is directed through sections of the track upon which the train rides, so that each section of track defines a portion of an electrical circuit. The presence of a train upon a section of track causes the circuit in which that track is included to short circuit. Signals, such as arrays of light or other visual indicators appropriately located throughout the system, respond to the short with the proper signal display. The signal displays through the system will change appropriately as the train moves through successive circuits.

As a simplified example, when no train is present upon a section of track, the circuit of which said track is a part, will cooperate with the light display or other visual indicator to provide a signal to approaching trains that they are permitted to proceed. On the other hand, if a train is present on a section of track, a short circuit will result that provides a signal which directs approaching trains not to proceed. An actual signal system used in railway operations, of course, is substantially more complex than this example. However, the signal systems employed in many railway operations employ the general principle of incorporating sections of rail into electrical circuits to detect the presence of trains, and in turn, to operate displays of signals.

The length of sections of rail that are incorporated into a signal circuit would vary according to operating speed of the system, alignment and geometrics of the track, operating characteristics of the equipment, visibility and other factors. As an example, however, the signal systems employed in many passenger subway operations are based upon circuits incorporating one thousand foot long sections of track. In certain areas of these subway systems, such as on curves, the signal circuits may be reduced in size to incorporate five hundred foot long sections of track or less.

It is essential that adjacent signal circuits be insulated from one another to avoid unintended short circuits that could cause an incorrect display of signals. Specifically, if the section of track in one signal circuit inadvertently is connected electrically to the section of track in the adjacent signal circuit, an incorrect control signal will result. In the typical railway operation this incorrect signal will be interpreted by the electrical circuitry as a train present on that section of track. Consequently, the signal circuit will trigger a signal display that will require approaching trains to stop.

To avoid shorts, adjacent signal circuits are insulated from one another. Specifically, end posts made of electrically non-conducting material such as polyurethane are placed between the rail sections of adjacent circuits. A typical end post is a planar member having a plan configuration substantially identical to the cross section of the rails. The joint bars that are used to securely connect adjacent sections of rail are partially wrapped in a flexible insulating fabric to further inhibit short circuits across the adjacent sections of rail, and insulating bushings are used to surround the bolts that extend through the joint bars and rail sections.

The standard end post used to separate rail sections in adjacent signal circuits is constructed from a plastic or polyurethane material having a thickness of approximately $\frac{3}{8}$ of an inch. It has been found that end posts having a thickness of $\frac{3}{8}$ of an inch or less will not directly support the weight of the train riding on the track. Rather, the weight of the train as transmitted through the wheels will be supported mostly by adjacent sections of track. However, as the thickness of the end post increases above $\frac{3}{8}$ of an inch, the proportion of the train weight carried by the structurally weak end posts also increases. As a result, end posts having a greater thickness are likely to wear very quickly, and in some circumstances to fail entirely. The wearing of thick end posts results in the end post assuming a concave or dish shaped configuration. Consequently, train wheels will not roll smoothly over these joints, but will abruptly contact the adjacent rail section. This abrupt contact across the discontinuous joint significantly affects the life and performance of the equipment riding on the track, and can cause failure of the joints between adjacent rail sections.

Although the end posts having a thickness of $\frac{3}{8}$ of an inch provide a long lasting mechanical connection, they are not particularly effective insulators. Specifically, the continuous movement of the heavy railway equipment over the rails causes metallic flakes to become separated from the rails. These metallic flakes and other electrically conductive dust particles in the railway system environment collect on the rails in the vicinity of the end post. This collection of metallic particles in the vicinity of the end post is encouraged by the weak magnetic field that is generated by the signal circuits in the adjacent rails. After a period of time, these electrically conductive metallic particles may extend across the end post bridging the gap between adjacent signal circuits. A short circuit will result from this continuous collection of metallic particles across the end post thereby resulting in the generation of an incorrect control signal.

In the typical railway system, the short circuit resulting from metallic particles bridging the gap established by the end post will result in a signal display that requires approaching trains to stop even though it is in fact safe for the trains to proceed. Typically, this signal malfunction can be corrected only by first locating the problem and then dispatching a maintenance crew to the area to eliminate the short circuit. This, of course, is time consuming and costly, and results in residual effects on the operation of trains throughout the entire railway system. It is estimated that in the New York City subway system, for example, signal malfunctions of this type occur several thousand times each year with a resultant substantial effect on the operation of the entire system.

Attempts have been made to increase the thickness of the insulated joints between adjacent signal circuits to minimize the possibility of electrically conductive particles bridging the gap established by the end posts. However, as explained above, these thicker insulated joints have resulted in mechanical deficiencies with long term operational effects that are at least as serious as the electrical malfunctions described above.

In view of the above, it is an object of the subject invention to provide an improved insulated joint between the rail sections of adjacent signal circuits.

It is another object of the subject invention to provide an insulated joint between rail sections of adjacent signal circuits that minimize the occurrence of short circuits.

It is an additional object of the subject invention to provide an insulated joint between rail sections of adjacent signal circuits that is capable of physically withstanding the forces exerted upon the connection during the operation of the railway system.

It is a further object of the subject invention to provide an insulated joint between rail sections of adjacent signal circuits that will assure an adequate mechanical connection between the rail sections.

It is still another object of the subject invention to provide an insulated joint between adjacent sections of rail in a signal circuit that is inexpensively manufactured and easily installed.

SUMMARY OF THE INVENTION

The subject insulated joint includes two nonconducting end posts, preferably of the standard $\frac{3}{8}$ inch thickness, separated by a metallic support separator that preferably is at least 1 inch thick. The metallic support separator has a plan configuration generally similar to the cross section of the rail, but as explained in greater detail below, the head and web sections preferably are designed to better support the forces exerted upon the separator by the train and to increase the life of the insulated joint.

As explained further below, it has been found that the mechanical performance of the insulated joint may be enhanced by removing from the area adjacent the metallic separator a portion of the insulating fabric that separates the joint bar from the rail. The head portion of the separator preferably has an area and plan configuration corresponding to the cross section of the rail head portion plus the insulating fabric. Thus, when assembled, the metallic separator head portion directly abuts the joint bar.

To provide additional support for the metallic separator on certain sections of track, such as curves, the separator may be provided with a head portion of even greater area, and a notch of a corresponding size then may be formed in the joint bars to accept the enlarged head portion of the metallic separator.

The subject insulated joint provides a structurally efficient mechanical connection, and also provides a sufficient separation between the adjacent electrical circuits of the rails so as to minimize undesirable electrical short circuiting.

DETAILED DESCRIPTION OF THE PREFERRED EMBODIMENT

Figure 1:
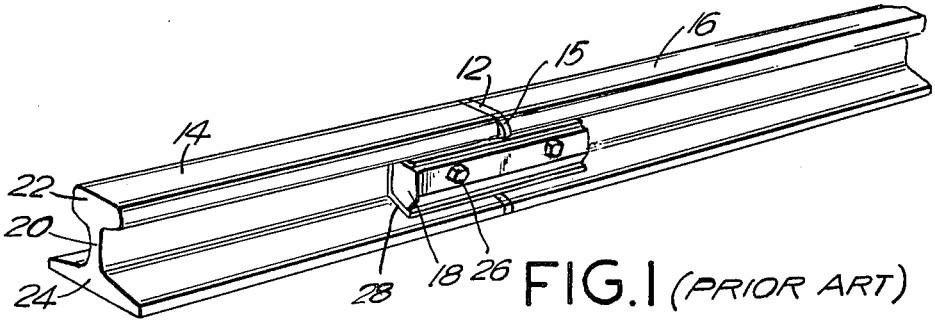
FIG.1 (PRIOR ART)
FIG. 1 is a perspective view of a prior art insulated joint in a rail system.

The prior art insulated joint, as shown in FIG. 1, includes an insulating end post 12 fixedly secured between sections of rails 14 and 16 that are disposed respectively in separate signal circuits. End post 12 is a planar member constructed from an electrically nonconducting material, such as polyurethane. The plan configuration of end post 12 is substantially identical to the cross sectional configuration of the rails 14 and 16 used in the system. However, end post 12 includes an extension 15 to facilitate placement and removal of end post 12. The principal mechanical connection between rails 14 and 16 is provided by joint bar 18 and a corresponding joint bar (not shown) on the opposite side of rails 14 and 16. The joint bar 18 is an elongated metallic member configured to fit precisely against the web portion 20 of rails 14 and 16 and extending between the head and base portions 22 and 24 thereof respectively. Holes in the joint bar 18 extend entirely therethrough, and are aligned with holes in rail sections 14 and 16 and in the other joint bar (not shown). Typically, at least two holes are provided in each rail 14 and 16 for appropriate alignment with joint bar 18. Bolts 26 are provided to secure joint bar 18 and the opposed joint bar (not shown) to rail sections 14 and 16, and thereby to mechanically connect rail sections 14 and 16 in the proper position with respect to one another.

In the prior art insulated joint, shown in FIG. 1, an insulating fabric 28, such as a plastic coated fiberglass material, is wrapped around at least the portion of joint bar 18 that contacts rail sections 14 and 16. Similarly, a second insulating fabric is partially wrapped around the joint bar affixed to the sides of rail sections 14 and 16 not visible in FIG. 1. Insulating fabric 28 is provided to ensure that joint bar 18 does not function as an electrical connection between rail sections 14 and 16. To further insulate rail sections 14 and 16 from one another, an insulating bushing (not shown) surrounds each bolt 26.

As explained above, the prior art insulated joint as shown in FIG. 1, resulted in many signal system malfunctions. Specifically, the maximum thickness of end post 12 is controlled by the inability of the insulating material 12 from which end post is constructed to withstand the forces exerted upon it by the passage of trains thereover. On the other hand, thin end posts, such as the industrial standard $\frac{3}{8}$ inch thick end posts, contribute to signal malfunctions when electrically conductive particles bridge the gap between track sections 14 and 16.

Figure 2:
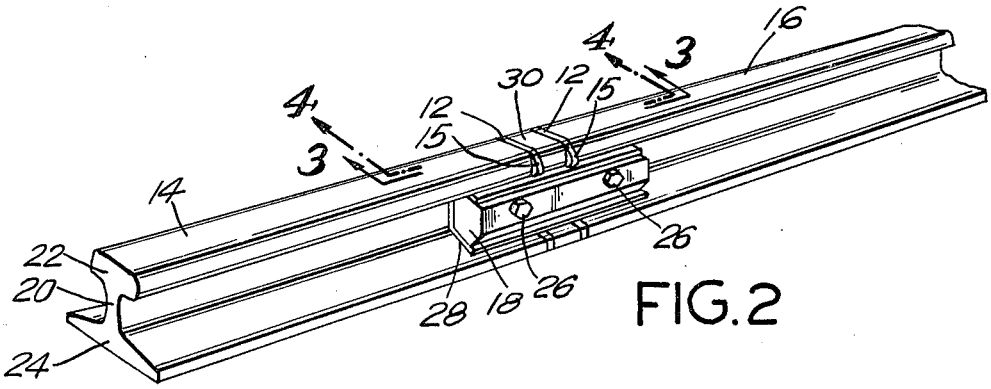
FIG. 2 is a perspective view of the new and improved insulated joint of the subject invention.
Figure 3:
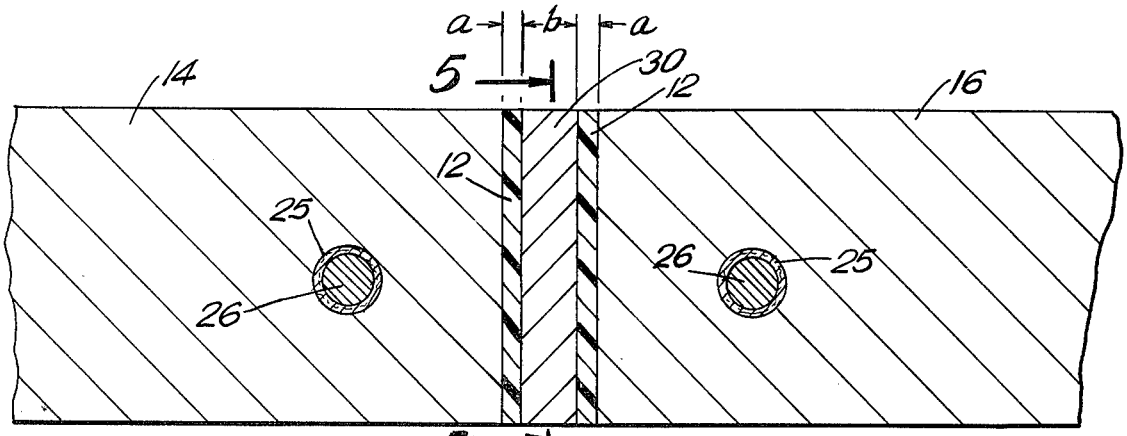
FIG. 3 is a cross sectional view, taken along line 3—3 in FIG. 2 as extending through the axis of symmetry of rail section employing the subject insulated joint.
Figure 4:
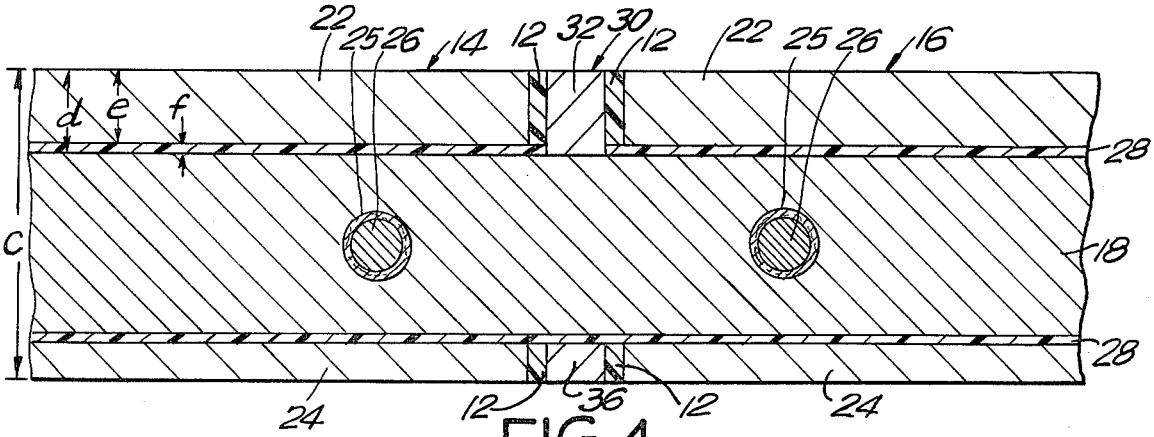
FIG. 4 is a cross sectional view of the subject insulated joint taken along line 4—4 in FIG. 2, which is offset from the web portion of the rail.

The insulated joint of the subject invention is illustrated in FIGS. 2 through 4. As with the insulated joint of the prior art, the subject insulated joint employs joint bar 18 and a second joint bar (not shown) to mechanically connect rail sections 14 and 16. Insulating fabric 28 extends at least partially around joint bar 18 to effectively insulate joint bar 18 from rail sections 14 and 16.

Also as with the prior art insulated joints, insulating bushings 25 surround the bolt 26 to insulate bolt 26 from track sections 14 and 16. The subject insulated joint differs substantially from the prior art insulated joint in that it employs separator 30 which is disposed intermediate a pair of end posts 12.

The structural combination of the subject insulated joint is illustrated more clearly in FIG. 3. Specifically, an end post 12 is disposed adjacent each rail section 14 and 16. End posts 12 of the subject invention preferably are the standard polyurethane end posts having a thickness indicated by dimension "a" in FIG. 3, equal to $\frac{3}{8}$ of an inch. The plan configuration of each end post 12 is substantially identical to the cross sectional configuration of each rail section 14 and 16, except that each end post 12 includes an extension portion 15 to facilitate insertion and removal. Separator 30 is a substantially planar member disposed between and in face to face contact with end posts 12. Separator 30 is constructed from a metallic material, such as steel, and has a thickness indicated by dimension "b" in FIG. 3, which preferably equals one inch. Even though separator 30 is formed from an electrically conductive material, end posts 12 effectively insulate metallic separator 30 from both rail sections 14 and 16. Insulating bushings 25 surround bolts 26 to assure that bolts 26 will not conduct electricity from either rail 14 or 16.

It is evident from FIG. 3 that the combination of end post 12 and metallic separator 30 enable a greater separation between rail sections 14 and 16 than has been provided by the prior art insulated joints. Specifically, when end posts 12 have a dimension "a" equal to $\frac{3}{8}$ of an inch, and separator 30 has a dimension "b" equal to one inch, rail sections 14 and 16 are separated from one another by $1\frac{3}{4}$ inches. This separation between rail sections 14 and 16, which is almost five times the separation relied upon in the prior art, substantially reduces the possibility of short circuits caused by the accumulation of electrically conductive particles between rail sections 14 and 16.

As discussed previously, an electrically effective insulated joint is of little use if it cannot also perform under the extremely demanding requirements that are imposed upon any rail joint. To ensure reliable mechanical performance of the subject insulated joint, the separator is provided with head and web portions that differ from the standard head and web portions of a rail cross section. More particularly, it has been found that if the plan configuration of the subject separator precisely corresponds to the cross sectional configuration of the rail, the head portion of the separator will rest upon the insulating fabric that is partially wrapped around the joint bar. The insulating fabric in turn would be disposed between the joint bar and the head portion of the separator. During operation of the rail system, the separator would be repeatedly forced against the insulating fabric and after a short time would wear the fabric away. Thus, the head portion of the separator would be urged into a lower position with respect to the head portions of the adjacent rail sections so that the separator head portion would eventually be in direct contact with the joint bar. This could result in the top surface of both the separator and the end post being lower than the top part of the adjacent rail sections. Consequently, train wheels would not roll smoothly over the joint but would repeatedly bang into contact with the adjacent rail sections. As explained above, this abrupt interaction of the train wheels with the joints can cause a failure of the joint and excessive wear on the rail equipment.

Figure 5:
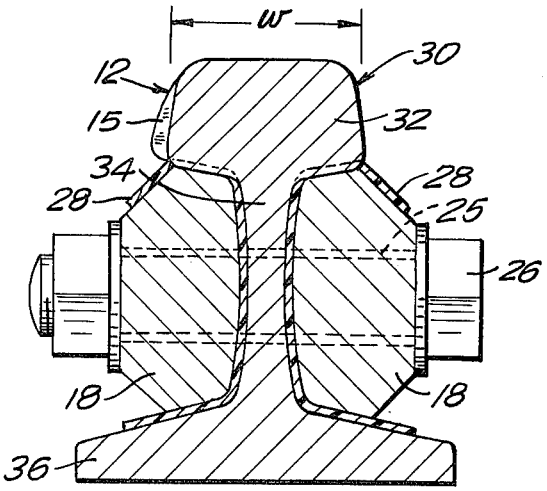
FIG. 5 is a cross sectional view of the subject insulated joint taken along line 5—5 in FIG. 3.

To eliminate the wearing of the insulating fabric 28 by the metallic separator 30, at least a portion of the insulating fabric 28 adjacent the metallic separator 30 is cut away, as shown in FIGS. 4 and 5. More particularly, metallic separator 30 includes head portion 32, web portion 34 and base portion 36. The distance from the top of head portion 32 to the bottom of base portion 36, as indicated by dimension "c", substantially equals the distance between the top of head portion 22 and the bottom of base portion 24 on rail sections 14 and 16. Similarly, the width of separator head portion 32, as indicated by dimension "w", substantially equals the width of head portion 22 on rail sections 14 or 16. However, as illustrated in FIG. 4, head portion 32 of metallic separator 30 has a height "d" which is greater than height "e" of head portion 22 of rail sections 14 or 16 by the thickness of insulating fabric 28, as indicated by distance "f". Thus, as illustrated in FIG. 5, head portion 32 of separator 30 will directly contact joint bars 18 thereby reducing the possibility of deterioration of insulating fabric 28 and the resultant joint misalignment. Alternatively, separator 30 and insulating fabric 28 may be configured so that the separator head 32 and at least a portion of the separator web 34 and/or base 36 will be of larger cross section than the equivalent portions of the rail. Thus, the separator head 32 and at least part of the separator web and/or base 34 and 36 will be in direct contact with the joint bars 18.

Figure 6:
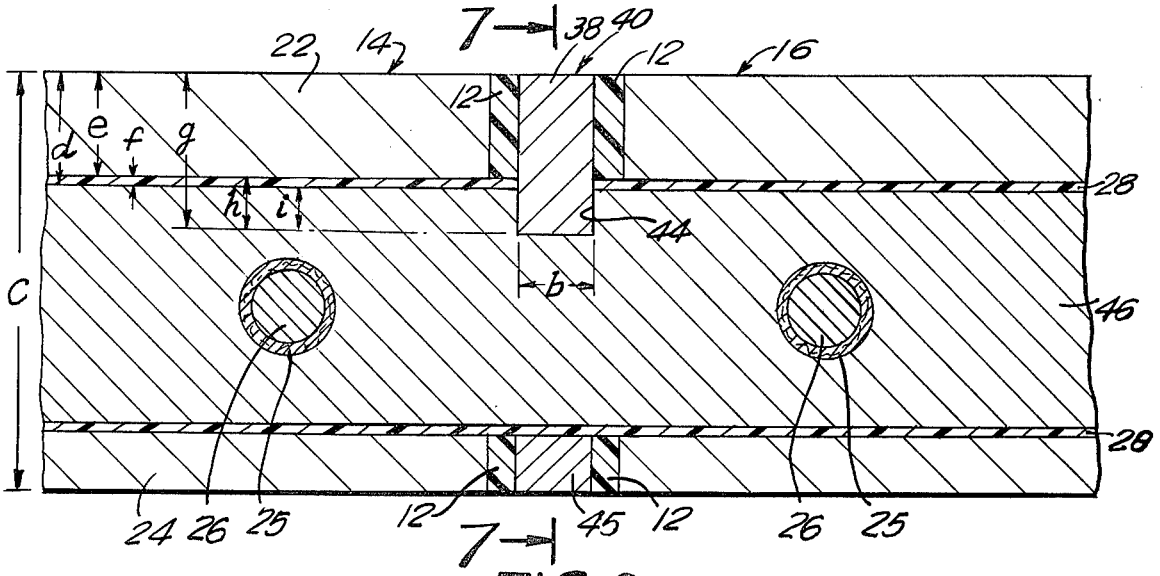
FIG. 6 is a cross sectional view similar to FIG. 4, but showing a second embodiment of the subject insulated joint, taken through a section offset from the web portion.
Figure 7:
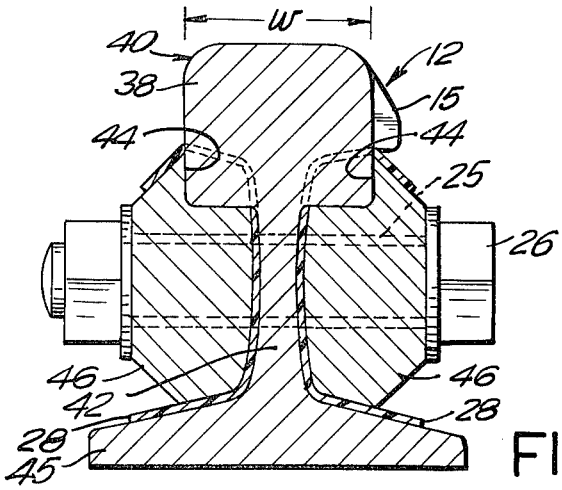
FIG. 7 is a cross sectional view of the subject insulated joint taken along line 7—7 in FIG. 6.

In certain areas of the railway system, such as on curves, greater forces are exerted upon the rail. These forces can cause a shearing of the separator at the juncture of the head and web portion just above the joint bar. To ensure that the separator will not fail at this location an alternative embodiment of the separator of the subject invention has been developed, as shown in FIGS. 6 and 7, in which the head portion 38 of separator 40 is of a substantially greater area than the head portion 22 of the rails 14 or 16. More particularly, the head portion 38 of metallic separator 40 has a height as indicated by dimension "g" in FIG. 6, which exceeds the height "e" of the head portion 22 of rail sections 14 or 16 by a distance indicated by dimension "h". To accommodate the greater height of head portion 38 on separator 40, joint bars 46 each are provided with a notch 44. Thus the head portion 38 of the metallic separator 40 is supported by the joint bars 46, thereby minimizing the possibility of shearing along the juncture of head portion 38 and web portion 42 of the metallic separator 40.

The dimension "h" can vary according to specific operating conditions and according to the point of measurement on head portion 38. However, a distance "h" of one inch at points on head portion 38 most distant from web portion 42 has proved acceptable under most operating conditions. Specifically, a head portion 38 having distance "h" equal to one inch and having a correspondingly shorter web portion 42 will be better able to tolerate both the vertical and horizontal components of the increased forces in these areas. It should be noted that head portion 38 has a width "w" equal to the width of the head portions of the separators and rail sections used throughout the systems.

Notch 44 in each joint bar 46 has a width "b" substantially equal to the thickness of metallic separator 40, as illustrated most clearly in FIG. 6. The depth of notch 44 as indicated by dimension "i" in FIG. 6 would vary due to the curved configuration of joint bar 46. However, the depth "i" plus the thickness "f" of insulating fabric 28, plus the heiqht "e" of the head portion of rail 14 or 16 would equal the height "g" of the head portion 38 on separator 40. The total height "c" of separator 40 from the bottom of base portion 45 to the top of head portion 38 is identical to the height of rail sections 14 and 16 and end posts 12.

Figure 8:
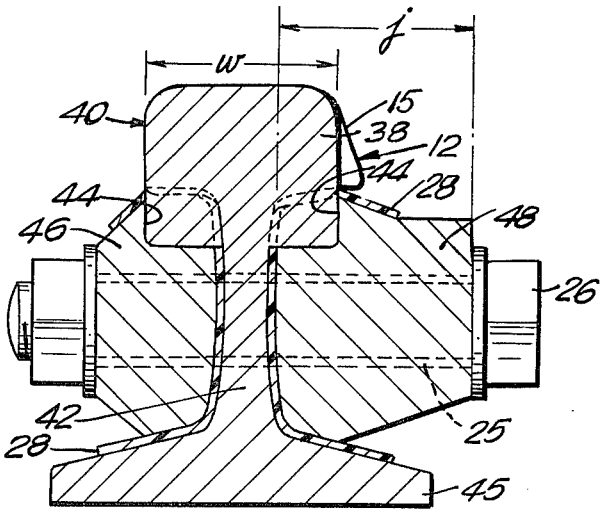
FIG. 8 is a cross sectional view similar to FIG. 5 but showing a third embodiment of the subject insulated joint.
Figure 10:
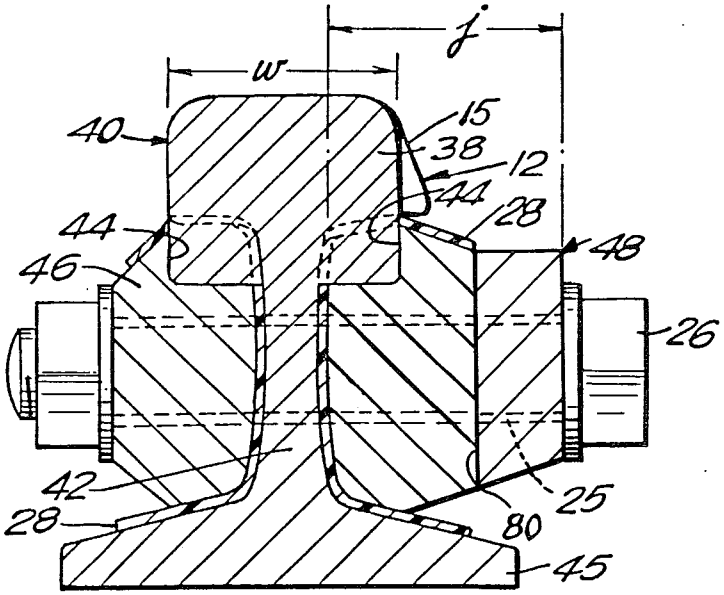
FIG. 10 is a cross sectional view similar to FIG. 8 but showing a fifth embodiment of the subject insulated joint.

FIG. 8 shows a third embodiment of the subject insulated joint that is particularly well adapted for use on certain curved sections. Specifically, on curved sections, an outwardly directed centrifugal force is exerted upon the rail, the separator and on the joint bar on the outside of the curve. The joint bar 46 shown in FIGS. 6 and 7 may not be able to adequately support the separator 40 at these locations and may itself be subject to failure as a result of any weakness that may be attributed to notch 44. To be certain that the joint bar, on the outside of certain curved sections can withstand the increased forces, a reinforced joint bar 48 is provided as shown in FIG. 8. Specifically, reinforced joint bar 48 has a thickness as indicated by dimension "j" that is significantly greater than the thickness of the standard joint bar 18 or joint bar 46 described above. This thickened section should be at a relative height with respect to the base portion 45 to provide adequate support for the juncture between the head and web portions 38 and 42 of the separator 40. The differences in thickness between reinforced joint bar 48 and the standard joint bar 18 would vary according to operating conditions and metallic oontent. However, it is anticipated that a reinforced joint bar 48 having a thickness of $1\frac{1}{2}$ inches greater than the standard joint bar 18 will perform well under most operating conditions. The reinforced joint bar 48 may be formed from a unitary piece of metal or may be fabricated from separate pieces of metal that are welded together along line 80 as illustrated in FIG. 10.

Figure 9:
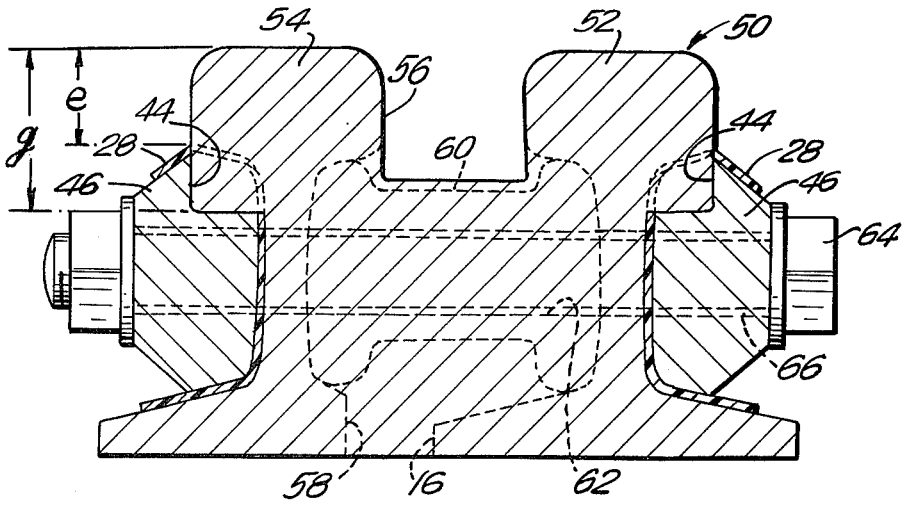
FIG. 9 is a cross sectional view similar to FIG. 5 but showing a fourth embodiment in which the subject insulated joint is used in conjunction with a guard rail.

A fourth embodiment of the subject invention is shown in FIG. 9 wherein the subject insulated joint is adapted for use at a location where a guard rail is employed. Specifically, guard rails are utilized at certain severe curves, switches, cross-overs and frogs. The guard rail is disposed adjacent the inside of the track to ensure that the flange of the wheel remains properly positioned with respect to the head portion of the rail. Standard end posts are available which substantially conform to the cross sectional configuration of both the primary rail and the guard rail, and also include a connecting portion to bridge the space between the primary and guard rails. More particularly, the end post entirely fills the space between the primary and guard rails except for a flange-way between the head portions of the primary and guard rails. As illustrated in FIG. 9, a separator 50 is provided with main and guard portions 52 and 54 and a flangeway 56 defining a notch between the main and guard rails 16 and 58 for accepting the flange of a wheel riding on the primary rail. A rail separator 60 extends intermediate the main and guard rails 16 and 58. The rail separator 60 would include through apertures 62 having corresponding spacing and dimension to the apertures in joint bars 46 for accepting bolts 64 and bushings 66. The insulating fabric 28 is disposed between the joint bars 46 and the main and guard rails 16 and 58. As explained previously, the insulating fabric 28 and at least the head portions of the separator 50 are configured so that at least the head portions of the separator 50 directly abut the joint bars 46. Optionally the separator 50 and the insulating fabric 28 could be configured so that, in addition to the separator head portions, at least part of the separator web and base portions directly abut the joint bars 46.

The separator 50, shown in FIG. 9, is disposed intermediate a pair of end posts, as described above. Additionally, the separator 50 of FIG. 9 often is used at locations where rails will be subjected to atypical stresses, such as on curves. Therefore, at these locations, the separator 50 has larger head portions then either the main or guard rails. Specifically, the height of the head portion of separator 50, as indicated by dimension "g", is substantially greater than the height "e" of the head portion of the main or guard rail. Typically, the difference between heights "g" and "e" would be approximately 1 inch. To accommodate the separator 50 with a head portion height "g" substantially greater than the height "e" of the rail head portion, each joint bar 46 must be provided with a notch 44 as explained above. Also, as explained with reference to FIG. 6, each notch 44 would have a width "b" substantially equal to the thickness of separator 50. In this manner, notches 44 in FIG. 9 are dimensioned to precisely accept the head portions of separator 50. When the guard rail 58 is used on extreme curves, it frequently will be used with a reinforced joint bar on the outside of the curve, comparable to the joint bar 48 shown in FIG. 8. When guard rails are used at switches or frogs, the notch 44 could be eliminated, and the separator head portion could be correspondingly smaller, similar to the embodiment shown in FIG. 5. In the latter instance a reinforced joint bar would not be necessary.

In summary, an insulated joint is provided which includes a metallic separator of sufficient strength to withstand forces exerted upon it by train wheels. The separator is disposed between a pair of end posts constructed from a non-conductive material. The combination of the separator and end post in turn is placed between rail sections which are disposed in adjacent signal circuits. The insulating fabric that is disposed between the joint bar and rail sections of an insulated joint is removed in the area immediately adjacent to the subject head portion thereby ensuring a joint that will not wear into a concave dish shape. In areas where the rails will be subject to greater than normal forces, such as on curves, the head portion of the separator is provided with a substantially greater height than the head portion of the standard rail with which it is used. To accommodate the greater height, a notch of equivalent configuration is removed from the joint bar. The greater height provided to the separator head portion makes it better able to withstand the forces exerted upon it particularly when combined with a reinforced joint bar. The subject separator may also be extended for application at insulated joints where guard rails are employed.

While the preferred embodiment of the subject invention has been described and illustrated, it is obvious that various changes and modifications can be made therein without departing from the spirit of the present invention which should be limited only by the scope of the claims.

What is claimed is:

1. An insulated joint for electrically insulating a space between two juxtaposed sections of rail, said joint comprising:

first and second electrically non-conductive end posts disposed in the space between said rails;

a metallic separator disposed intermediate said end posts, said metallic separator including an upstanding web having a top and a bottom and further including a head and a base rigidly connected respectively to said web top and bottom; and joint bar means rigidly joining said sections of rails, said joint bar means being electrically insulated from said sections of rail, said joint bar means including at least one notch, said separator head extending into said notch and contacting said joint bar at said notch thereby reducing the possiblility of said separator failing.

2. An insulated joint as in claim 1 wherein said joint bar means further includes a reinforcing member to support said separator and said joint bar means adjacent said notch.

3. An insulated joint as in claim 2 wherein said reinforcing member is welded to at least a portion of said joint bar means.

4. An insulated joint as in claim 2 wherein said reinforcing member is formed integrally with at least a portion of said joint bar means.

5. An insulated joint as in claim 1 wherein two juxtaposed sections of guard rail are disposed parallel respectively to said two sections of rail such that a space is defined between said sections of guard rail, said end posts and said separator extending from the space between said sections of rail into the space between said sections of guard rail.

6. An insulated joint as in claim 1 wherein said sections of rail and said end posts each include an upstanding web having a top and a bottom, a base and a head connected respectively to the bottom and top of said web, the heights of said sections of rail, said end posts and said separator measured between locations on the respective heads and bases opposite the respective webs being equal.

7. An insulated joint as in claim 6 wherein said joint bar means includes two joint bars, said insulated joint further including a layer of insulating material disposed intermediate each said joint bar and said sections of rail, and intermediate each said joint bar and said base and web of said separator.

8. An insulated joint as in claim 1 wherein the portion of said separator in direct contact with said joint bar means further includes said separator web and part of said separator base.

9. An insulated joint for electrically insulating a space between two juxtaposed sections of rail, said joint comprising:

two electrically non-conductive end posts disposed in said space between said rails;

a metallic separator disposed intermediate said end posts, said separator including an upstanding web having a top and a bottom, a head and a base connected respectively to said separator top and bottom;

joint bar means including a pair of elongated joint bars rigidly joining said rails; and a layer of electrically insulative material disposed intermediate each said joint bar and both said end posts and said second sections of rail, and also disposed intermediate said joint bars and both the base and at least a portion of said web of said separator, said insulative material being notched such that the head of said separator is in direct contact with the joint bar.

10. An insulated joint for electrically insulating a space between two juxtaposed sections of rail, said joint comprising: first and second electrically non-conductive end posts disposed in the space between said rails; a metallic separator disposed intermediate said end posts; said sections of rail, said end posts and said separator each including an upstanding web having a top and a bottom, a base and a head connected respectively to the bottom and top of each said web, the heights of said sections of rail, said end posts and said separator measured between locations on the respective heads and bases opposite the respective webs being equal; a pair of joint bars rigidly joining said sections of rail; and a layer of insulating material disposed intermediate each said joint bar and said sections of rail, and intermediate each said joint bar and said base and web of said separator, the distance between the separator base and head being less than the distance between the rail base and head by an amount equal to the thickness of said layer of insulating material.

* * * * *